US006126013A

United States Patent [19]

Miller

[11] Patent Number: 6,126,013

[45] Date of Patent: Oct. 3, 2000

[54] EMBOSSED PLASTIC SHEET AND METHOD OF MANUFACTURE

[75] Inventor: William R. Miller, Kent, Wash.

[73] Assignee: Pyramid Plastics, LLC, Kent, Wash.

[21] Appl. No.: 09/209,144

[22] Filed: Dec. 10, 1998

[51] Int. Cl.[7] ..... B65D 81/03

[52] U.S. Cl. ..... 206/591; 206/308.1; 383/105; 428/35.2

[58] Field of Search ..... 206/521, 522, 206/591, 308.1, 445; 383/105; 428/35.2, 35.5, 156, 178

[56] References Cited

U.S. PATENT DOCUMENTS

| | | | |
|---|---|---|---|
| D. 244,319 | 5/1977 | Kies | D87/3 G |
| D. 244,802 | 6/1977 | Kies | D87/3 G |
| D. 244,803 | 6/1977 | Kies | D87/3 G |
| D. 244,804 | 6/1977 | Kies | D87/3 G |
| D. 245,042 | 7/1977 | Plumb | D87/3 G |
| D. 246,073 | 10/1977 | Kies | D87/3 G |
| D. 246,074 | 10/1977 | Kies | D87/3 G |
| D. 253,434 | 11/1979 | Mittman et al. | D92/1.1 |
| D. 259,594 | 6/1981 | Weitzman | D92/1.1 |
| 3,933,558 | 1/1976 | Takahata et al. | 156/209 |
| 3,954,368 | 5/1976 | Kawakami | 425/326 R |
| 3,974,958 | 8/1976 | Ruda | 229/55 |
| 4,052,236 | 10/1977 | Kapasi et al. | 156/85 |
| 4,076,789 | 2/1978 | Geller et al. | 264/259 |
| 4,079,114 | 3/1978 | Bonner | 264/210 R |
| 4,091,910 | 5/1978 | Bolton et al. | 400/131 |
| 4,193,959 | 3/1980 | Lemelson | 264/166 |
| 4,234,300 | 11/1980 | Yamagisi et al. | 425/363 |
| 4,244,683 | 1/1981 | Rowland | 425/143 |
| 4,250,135 | 2/1981 | Orsini | 264/227 |
| 4,259,285 | 3/1981 | Baumgartl et al. | 264/284 |
| 4,273,820 | 6/1981 | Swietzer | 428/159 |
| 4,332,847 | 6/1982 | Rowland | 428/156 |
| 4,415,515 | 11/1983 | Rosenberg | 264/68 |
| 4,459,772 | 7/1984 | Kanzelberger | 40/152.1 |
| 4,557,779 | 12/1985 | Bower et al. | 156/219 |
| 4,567,011 | 1/1986 | Nalle | 264/504 |
| 4,579,708 | 4/1986 | Rosart | 264/227 |
| 4,614,632 | 9/1986 | Kezuka et al. | 264/280 |
| 4,734,313 | 3/1988 | Wong | 428/159 |
| 4,737,329 | 4/1988 | Rakoczy | 264/132 |
| 4,796,160 | 1/1989 | Kahn | 362/19 |
| 4,818,465 | 4/1989 | Mente | 165/522 |
| 4,912,828 | 4/1990 | Chernuchin et al. | 29/434 |
| 5,080,742 | 1/1992 | Takahashi | 156/212 |
| 5,203,941 | 4/1993 | Spain et al. | 156/209 |
| 5,238,642 | 8/1993 | Benquet et al. | 264/284 |
| 5,268,138 | 12/1993 | Fetterhoff et al. | 264/284 |
| 5,284,693 | 2/1994 | Spain et al. | 428/172 |
| 5,364,381 | 11/1994 | Soga et al. | 604/366 |
| 5,410,963 | 5/1995 | Steadman | 101/376 |
| 5,506,031 | 4/1996 | Spain et al. | 428/172 |
| 5,662,977 | 9/1997 | Spain et al. | 428/42.1 |
| 5,692,607 | 12/1997 | Brosmith et al. | 206/308 |
| 5,837,102 | 11/1998 | Graf | 162/296 |

*Primary Examiner*—Jim Foster

*Attorney, Agent, or Firm*—Sean M. Casey; Standley & Gilcrest

[57] ABSTRACT

An embossed plastic sheet material is molded to have a relief image with a peripheral edge that is formed by a partial shearing of the material of the plastic sheet near or at the peripheral edge so that the image lasts longer and does not relax or deteriorate naturally or with repeated and prolonged use. Also disclosed is a protective container made from the embossed plastic sheet material that can be used in a carrying case and an album to safely store and transport valuable and collectible items including coins, bottle tops, pogs, optical disks, magnetic disks, audio and video disks and tapes, stamps, photographs, match books, and other similar items. An embossing roller assembly is also described that can be used to fabricate the embossed plastic sheet material.

4 Claims, 7 Drawing Sheets

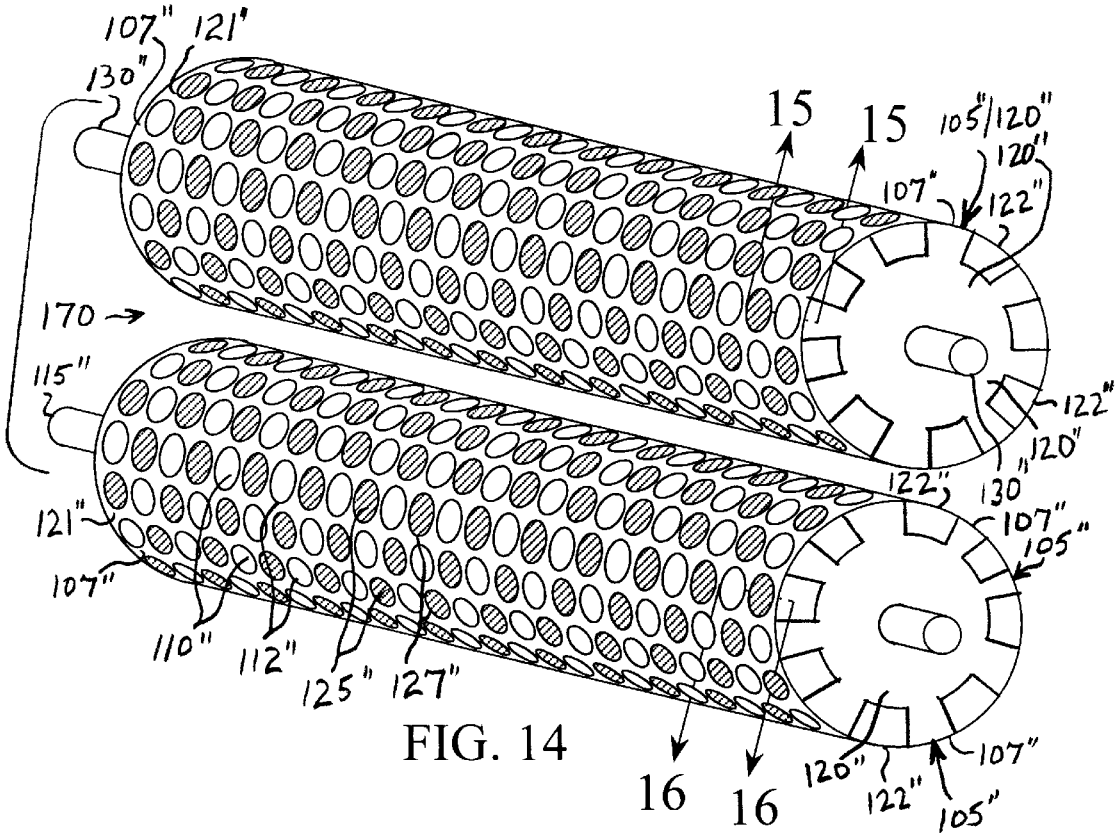
FIG. 14
FIG. 15
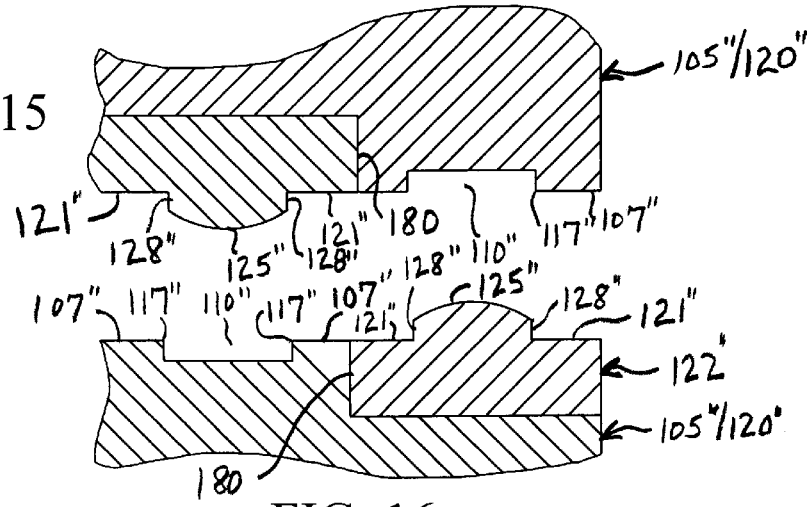
FIG. 16

EMBOSSED PLASTIC SHEET AND METHOD OF MANUFACTURE

BACKGROUND OF THE INVENTION

1. Field of the Invention

The present invention relates generally to the embossing of sheet materials including thermoplastics and more particularly to a thermoplastic embossed sheet manufactured using an inline positive-driven embossing station.

2. Background

The need for embossed plastic materials has continued for some time and has had particular application in the development of products capable of safely containing and protecting valuable and collectible items during handling, inspection, buying, selling, storage, and transportation of such items. In the past, a wide variety of embossed plastic materials have been used in the construction of products such as protective containers for use in albums, carrying cases, and filing containers that are designed to hold such valuable and collectible items and objects. Such valuable and collectible items include, but are not limited to, coins, bottle tops, pogs, optical disks, magnetic disks, audio and video disks and tapes, stamps, jewelry, electronic chips or chip sets such as processors and memory chips and EPROMs, photographs, negatives, match books, and other similar items and objects.

Such protective containers often include two or more plastic sheets joined together to form a protective pocket within which an item may be inserted for storage and display. The shape of the pocket is designed to accommodate the type of item to be protected and stored. Often the plastic sheets are formed to have a generally rectangular shape of a size suitable for holding the item to be protected. The sheets are typically joined by adhesives, welds, staples, rivets, or other appropriate fastening means to form a seam along three sides leaving one side of the pocket open so that an item may be readily inserted and removed from the pocket. In some protective container products, one or more of the plastic sheets will be embossed with a three-dimensional preselected image or image pattern that is designed to improve the appearance and protective capability of the protective containers.

Most commonly, the images that are embossed or molded into plastic sheet materials have been formed, molded, embossed, imprinted, or impressed using any of a number of plastic finishing techniques including calendering, compression molding, cold forming, injection molding, thermoforming, and transfer molding. Typically, a combination of calendering and cold forming has been used to emboss a material as part of a larger manufacturing and assembly production line wherein the embossed plastic sheet material is directed into an assembly line which incorporates the embossed sheet into the protective container, sleeve, or container.

Such an embossing station is configured to mold, form, emboss, imprint, or impress an image pattern into a sheet of plastic material that is drawn from a roll. The impressed or embossed plastic material is then fed into a later stage of the manufacturing and assembly production line and the material is incorporated into a finished component or product. The embossing station usually includes a die press or a pair of rollers. The high-speed processing of plastic sheet material typically employs platen and die rollers to emboss the plastic sheet with the preselected image or image pattern. The die roller includes a die in the shape of the preselected image or a pattern of such dies. The platen roller may have a flat surface about its circumference or it may incorporate a recess or pattern of recesses corresponding with the embossing die or pattern of dies, respectively. During embossing, the portion of the plastic sheet material in contact with the die (or die and platen) is momentarily stretched into the three-dimensional shape of the preselected image or image pattern as the sheet passes through the rollers, thus impressing or forming the preselected image into the plastic sheet material.

Although many types of plastic embossing techniques have been employed to emboss an image pattern onto plastic sheet, a persistent problem has existed. After the stored object or item is removed from the protective container or page of protective containers, the embossed image typically fails to fully recover its original three-dimensional shape. Therefore, when the embossed protective container is reused, the embossed article cannot function as intended—to provide a cushioned surface to protect the valuable collectible or article. Moreover, any aesthetic value attributable to the embossed image is lost.

The currently known embossed images in widely used materials suffer from dimensional instability in that the embossed image usually deteriorates rapidly after embossing because the plastic material naturally and gradually relaxes so that the image pattern flattens considerably.

In addition to the natural relaxation of the embossed plastic material, the image further deteriorates and flattens when it is used in a protective container for storage or transportation of an object. The additional deterioration results from the compressive and tensile effects experienced by the plastic material when an object is inserted into the pocket of the protective container. The pocket and therefore the joined plastic sheets are necessarily distended slightly from their natural orientation and the plastic sheets experience a tension in the plane of the sheet material. In response to such tension, the plastic sheet material is pressed against the object in the pocket. In other words, the embossed image is stretched in the planar direction of the sheet material and the image is pressed flat against the object. These multiple sources of deterioration serve to significantly and undesirably reduce the aesthetic value and protective function of the embossed image or image pattern.

What has been needed but previously unavailable is an improved, inexpensive, durable, and long-lasting embossed plastic sheet material and a method for manufacturing such material that overcomes the deficiencies of the presently known materials and methods for manufacture. In addition to these concerns, such advancements must improve the cushioning capability of the embossed plastic materials used in protective containers by increasing the post-embossing relief height, resilience, durability, and three-dimensional stability of the embossed image. Ideally, the preferred embossed plastic material will also minimize the surface area of plastic in contact with the item stored in the protective container to, in turn, minimize the frictional abrasion acting upon the item, by the plastic material, as the item is inserted and removed from the protective container.

SUMMARY OF THE INVENTION

The present invention provides an advancement over previous embossed plastic materials and methods for manufacture. The invention includes an embossed plastic material in the form of a sheet with at least one relief image or pattern of images molded on the sheet to have a stepped circumfluent periphery formed on at least one of the surfaces of the sheet. Preferably, the stepped periphery is formed on one of the flat surfaces of the plastic sheet material with a die and a platen. As the die and the platen come together against each opposite side of the plastic sheet, the stepped periphery is preferably formed as a result of a partial shearing or fracture of the plastic material on the side of the die and in a region of the plastic sheet material approximately adjacent to the stepped periphery.

The invention also includes a method for manufacturing an embossed plastic material which includes selecting a sheet of plastic material and molding the material to have at least one relief image or a pattern of images. Each image is formed to have a stepped circumfluent periphery formed on at least one side or surface of the sheet. During the molding step, the stepped periphery is formed with a die and a platen that come together to partially shear or fracture the plastic material in a region approximately adjacent to the stepped periphery.

The present invention also contemplates a protective container incorporating a plurality of generally rectangular plastic sheets bound together at a welded, stitched, riveted, or stapled seam along three sides. A fourth side remains open to a pocket formed between at least two of the plurality of sheets. At least one embossed image is molded on at least one of the sheets. The image is formed to have a peripheral edge surrounding the image. The peripheral edge is formed on at least one of the surfaces of the sheet. The edge is formed as the material approximately near the edge is partially fractured or sheared from impressing the embossed image in the plastic material. In a variation of this embodiment of the present invention, first and second plastic sheets of the plurality are arranged to have a third plastic sheet of the plurality interposed between the first and second sheets. The third sheet is formed with at least one embossed image or a pattern of images.

In another embodiment of the present invention, an album for containing valuable and collectible items is described. The album incorporates a plurality of protective containers arranged on generally rectangular pages in the album. Each of the containers includes a plurality of plastic sheets joined together at a seam with an opening to a pocket formed between at least two of the plurality of sheets.

The present invention also describes a portable carrying and storage case configured with a front and a back cover joined at a spine. The cover is made from a sturdy and flexible material such as a woven durable, fabric typically in use for book bags, back packs, and the like. The cover incorporates a fastening closure means well known to the art, such as hook and loop, belt and buckle, tie straps, and snap together fasteners for releasably securing the front cover to the back cover. The carrying case includes a plurality of leaflets attached along an edge thereof to the case. Most commonly, the leaflets are attached at an edge to the spine of the cover although this is not a requirement. Attached to each leaflet are one or more protective containers. Each container includes a plurality of plastic sheets bound together at a seam with an opening to a pocket formed between at least two sheets of the plurality. At least one of the plastic sheets of each container is molded with at least one embossed image or pattern of images. Each embossed image is formed to have an edge surrounding the image. The edge is formed on at least one side or surface of the plastic sheet. The edge is formed because the plastic material approximately near the edge is fractured or partially sheared as the embossed image is impressed into the plastic sheet.

Also contemplated and described by the present invention is an embossing roller assembly configured to impress an embossed image on a sheet of plastic material. The assembly incorporates at least two rollers, although more than two can be used in certain applications. The first roller is preferably a platen roller having a platen surface configured with at least one emboss recess or etched depression, or a pattern of such, shaped in the form of a preselected image. The second roller is preferably an impressing roller with an impressing surface including at least one emboss die, or a pattern of such emboss dies, shaped in the form of the preselected image. The platen and impressing rollers are cooperatively compressed together in a synchronized rotational relationship. The plastic sheet material is rolled through the roller assembly to form at least one relief image in the plastic sheet material in the shape of the preselected image. As with preceding embodiments, each formed image includes a stepped circumfluent periphery formed on at least one of the surfaces of the sheet. The edge or periphery is formed by a fracturing or partial shearing of the plastic sheet material in a region approximately adjacent to the stepped periphery on the at least one surface.

Other features and advantages of the invention will become apparent from the following detailed description, taken in conjunction with the accompanying drawings, which illustrate, by way of example, the features of the present invention.

BRIEF DESCRIPTION OF THE DRAWINGS

Without limiting the scope of the present invention as claimed below and referring now to the drawings, wherein like reference numerals and numerals having primes and double primes across the several views refer to identical, corresponding, or equivalent features and parts:

FIG. 14 is an elevated, partial perspective view, in reduced scale, of a roller assembly incorporating rollers configured to fabricate another preferred embodiment of the embossed plastic material of FIGS. 1 and 2B;

FIG. 15 is a partial, rotated, cross-sectional view taken along section line 15—15 of FIG. 14, in enlarged scale, of one of the rollers of the assembly of FIG. 14;

FIG. 16 is a partial, rotated, cross-sectional view taken along section line 16—16 of FIG. 14, in enlarged scale, of another of the rollers of the assembly of FIG. 14.

DETAILED DESCRIPTION OF THE PREFERRED EMBODIMENTS

Manufacturers and users of various types of embossed plastic materials have long been challenged by the need to improve the post-embossing relief height, resilience, durability, and three-dimensional stability of the embossed image. Although various types of such embossed plastic materials are known or available for use, each type presents its own peculiar problems and inadequacies, as described above.

Figure 1:
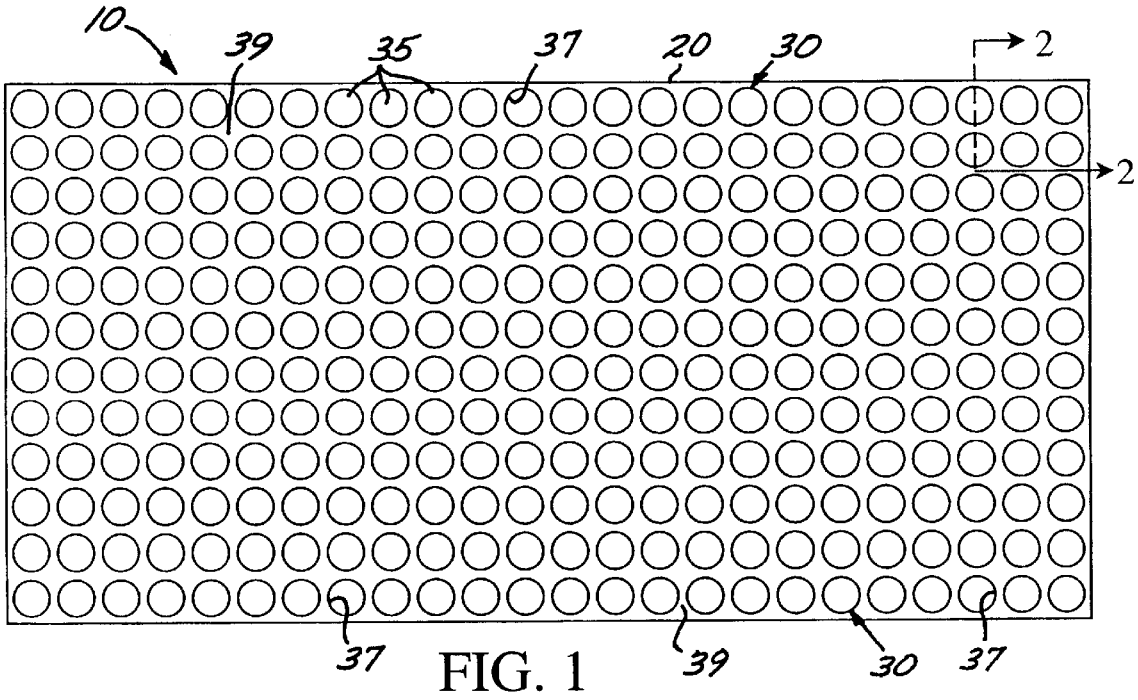
FIG. 1 is a planform view, in reduced scale, of a sheet of embossed plastic material of a preferred embodiment of the present invention.

The present invention provides a significant improvement over previously known embossed plastic materials and the methods for manufacture of such materials. With reference to FIG. 1, the invention includes an embossed plastic material 10 in the form of a sheet 20 with at least one preselected relief image 30 or pattern of images 35 molded into the sheet 20. Each image has a stepped circumfluent periphery or peripheral edge 37 formed on at least one of the surfaces 39 of the sheet 20 and surrounding the image. Preferably, the stepped periphery 37 is formed on one of the flat surfaces 39 of the plastic sheet material 20 with a die and a platen (as shown in later views). As the die and the platen come together against each opposite side of the plastic sheet 20, the stepped periphery 37 is formed as a result of a partial shearing or fracture of the plastic material 20 on the side of the plastic sheet material pressed against the die and in a region of the plastic sheet material 20 approximately adjacent to the stepped periphery 37.

Figure 2A:
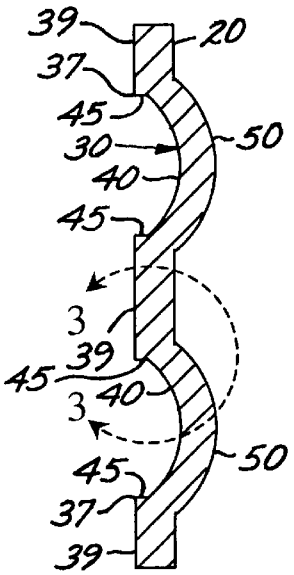
FIG. 2A depicts a partial, cross-sectional view taken along section line 2—2, in enlarged scale, of the embossed plastic material of FIG. 1.
Figure 2B:
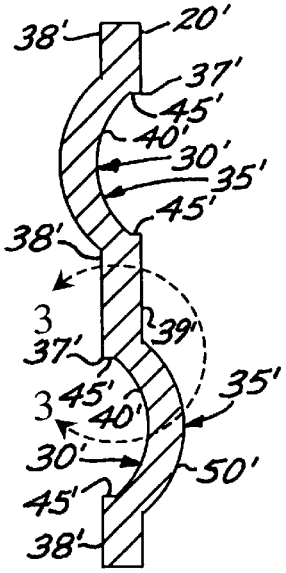
FIG. 2B depicts a partial, cross-sectional view taken along section line 2—2, in enlarged scale, of another preferred embodiment of the embossed plastic material of FIG. 1.
Figure 3:
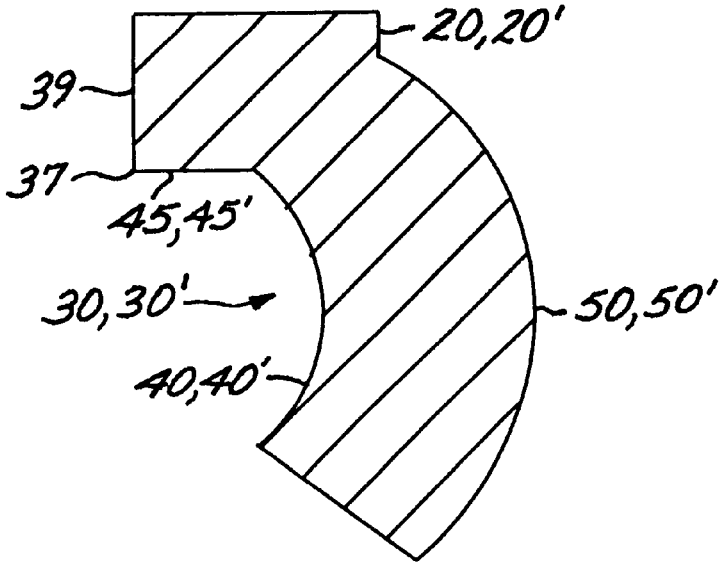
FIG. 3 is an enlarged, partial section view taken within the region surrounded by section line 3—3 of the cross-sectional views of FIGS. 2A and 2B.

The formation of the image 30 or pattern of images 35 is also depicted in FIGS. 2A and 2B. FIG. 2A, and enlarged section view FIG. 3, depict the sheet of plastic material 20 having the images 30 formed from one surface 39 in the plastic sheet 20. Although the article and method of the present invention are easily adaptable to emboss the two- or three-dimensional shape of any conceivable image into a plastic sheet, in this embodiment, the preselected image is, for purposes of illustration and not limitation, a portion of a sphere or a bubble. The bubble is formed by pressing a die against one surface 39 of the plastic sheet 20 that, in turn, is then pressed against a platen to form an embossed concave cavity 40 in the sheet in the shape of the preselected image 30. This, in turn, forms a protruding convex bump 50 on the opposite surface of the plastic sheet 20. In forming the bubble 40, a circumfluent stepped periphery or peripheral edge 37 is formed by the fracture or partial shearing of the plastic material from surface 39 in a region approximately adjacent to the stepped periphery 37 and by pushing, extruding, or compressing the fractured or partially sheared material along step portion 45.

The fracture or partial shearing of the material near the stepped periphery 37 significantly increases the post-embossing relief height, resilience, durability, and three-dimensional stability of the embossed image. First, the fracture or partial shearing minimizes the effects of the natural and gradual post-embossing relaxation of the plastic material because the surface shear line of the plastic material surface 39 experiences a discontinuity at the circumfluent periphery or edge 37. In other terms, the shape memory of the plastic sheet material 10 is permanently altered from a generally planar sheet 20 to the shape of the preselected image 30 with the circumfluent periphery 37. Accordingly, the plastic sheet material 10 is prevented from returning to its original planar configuration in the region of the embossed preselected image 30. An additional benefit resulting from this shearing or fracture is that when the plastic sheet 20 experiences tension along the surface 39 during use of the sheet 20 for storage of objects, the tensile forces within the plastic material do not act upon the embossed concave surface 40 of the image. Therefore no force component of the tensile forces can force or urge surface 40 towards its original, pre-embossed generally planar shape or towards a post-impression decreased emboss relief height or increased flatness. In turn, the surface 40 cannot be forced to and does not tend to return to its previous generally planar shape.

Additionally, the shearing or fracturing of the surface of the plastic sheet material 20 in the region of the circumfluent periphery or edge 37 physically relocates, extrudes, pushes, or compresses plastic material from the surface 39 along stepped portion 45 to surface 40. This, in turn, increases the amount of plastic material in the region where the surface 40 meets the stepped portion 45. The increased amount of plastic material serves to "shore up" or reinforce the position of the plastic material between surface 40 and surface 50. The reinforcement improves the ability of the embossed image 30 to retain its shape and post-impression relief height (as to surface 50 or depth (surface 40).

Each of the preceding factors plays an important role in establishing the improvements and advancements of the present invention with respect to increasing the post-embossing relief height, resilience, durability, and three-dimensional stability of the embossed image.

In the present embodiment, the plastic sheet material 20 is preferably, for purposes of illustration and not limitation, a smooth or non-glare, textured cast polypropylene sheet material with a preferable thickness of approximately 120 microns to approximately 125 microns, and a more preferable minimum thickness of 120 microns (0.120 millimeters or 0.00472 inches) and a maximum thickness of 125 microns (0.125 millimeters or 0.00492 inches). Such material within this approximate range of thicknesses is available from several domestic and foreign vendors including Solvay Industrial Films of LaPorte, Ind., and Renolit of Salzgitter, Germany. Many other types and thicknesses of plastic sheet material are equally suitable for purposes of the present invention and such materials are described in more detail in the third edition of the publication entitled *Handbook of*

*Plastics, Elastomers, and Composites* by Charles A. Harper (McGraw Hill 1996). One particularly useful additional list of such vendors is published as Appendix C to this publication.

The preferred height of the convex portion of the bubble 50, for purposes of illustration and not limitation, from the surface of the sheet opposite to surface 39 is approximately 0.020 inches (1.146 millimeters) to approximately 0.030 inches (1.719 millimeters), and more preferably is approximately 0.025 inches. The preferred depth of the fracture or partial shearing of the edge 37 from surface 39 and along step portion 45 is, for purposes of illustration and not limitation, approximately 0.1 millimeters (100 microns or 0.00394 inches) to approximately 0.5 millimeters (500 microns or 0.0197 inches), and more preferably is approximately 0.3 millimeters (300 microns or 0.0118 inches). The preferable two-dimensional bubble diameter measured in the plane of the sheet of plastic material is, for purposes of illustration and not limitation, approximately 0.24 inches (13.89 millimeters) to approximately 0.31 inches (18.06 millimeters), and more preferably is approximately 0.27 inches (15.66 millimeters). The bubbles are preferably spaced apart in a pattern on the plastic sheet with a bi-directional center-to-center spacing, for purposes of illustration and not limitation, of approximately 0.308 inches (17.94 millimeters) to approximately 0.318 inches (18.54 millimeters), and more preferably is approximately 0.3125 inches (18.21 millimeters).

Although representative dimensions are set forth, they are presented only for purposes of demonstrating a particular embodiment of the present invention and not for purposes of limitation. One having ordinary skill in the art will understand that various types and thicknesses of plastic, elastomer, and composite materials, and corresponding changes to the dimensions of the preselected image, are contemplated for use with the present invention.

Next, as can be understood with particular reference to FIG. 2B, and enlarged section view FIG. 3, a variation of the present embodiment is shown. In this variation the formation of the image 30' or pattern of images 35' is also having every other of the images 30' shown, configured in an alternating orientation wherein the images 30' alternate between concave and convex bubble shapes with respect to surfaces 38' and 39'. FIG. 2B depicts the sheet of plastic material 20' having the images 30' formed or embossed from each of the two surfaces 38', 39' into the plastic sheet 20'.

As with preceding embodiments, the article and method of the present variation of the present invention are easily adaptable to emboss the two- or three-dimensional shape of any conceivable image into the plastic sheet 20, 20' with any conceivable image, pattern of images, and alternating patterns of images. For purposes simplicity of presentation, in this embodiment, the preselected image 30' is again a portion of a sphere or a bubble. The bubble in the lower half of FIG. 2B is formed by pressing a die against one surface 38' of the plastic sheet 20' that, in turn, presses against a platen to form an embossed concave cavity 40' in the shape of the preselected image 30'. This, in turn, forms a protruding convex bump 50' on the opposite surface 39' of the plastic sheet 20'. In forming the bubble 40', a circumfluent stepped periphery or edge 37' is formed by the fracture or partial shearing of the plastic material in a region approximately adjacent to the stepped periphery 37' from surface 39' along step portion 45' as described with respect to the preceding embodiment.

The bubble in the upper half of FIG. 2B in the alternating direction is formed by pressing a die against the surface 39' of the plastic sheet 20' that, in turn, presses against a platen to form an embossed concave cavity 40' in the shape of the preselected image 30'. This, in turn, forms a protruding convex bump 50' on the opposite surface 38' of the plastic sheet 20'. As before, in forming the bubble 40', a circumfluent stepped periphery or edge 37' is formed in the same manner as described with respect to the preceding embodiments. As will be apparent to those with skill in the art, many variations and combinations of the preceding constructions are possible to achieve a wide variety of improved embossed images, and configurations and patterns of such images.

Figure 4:
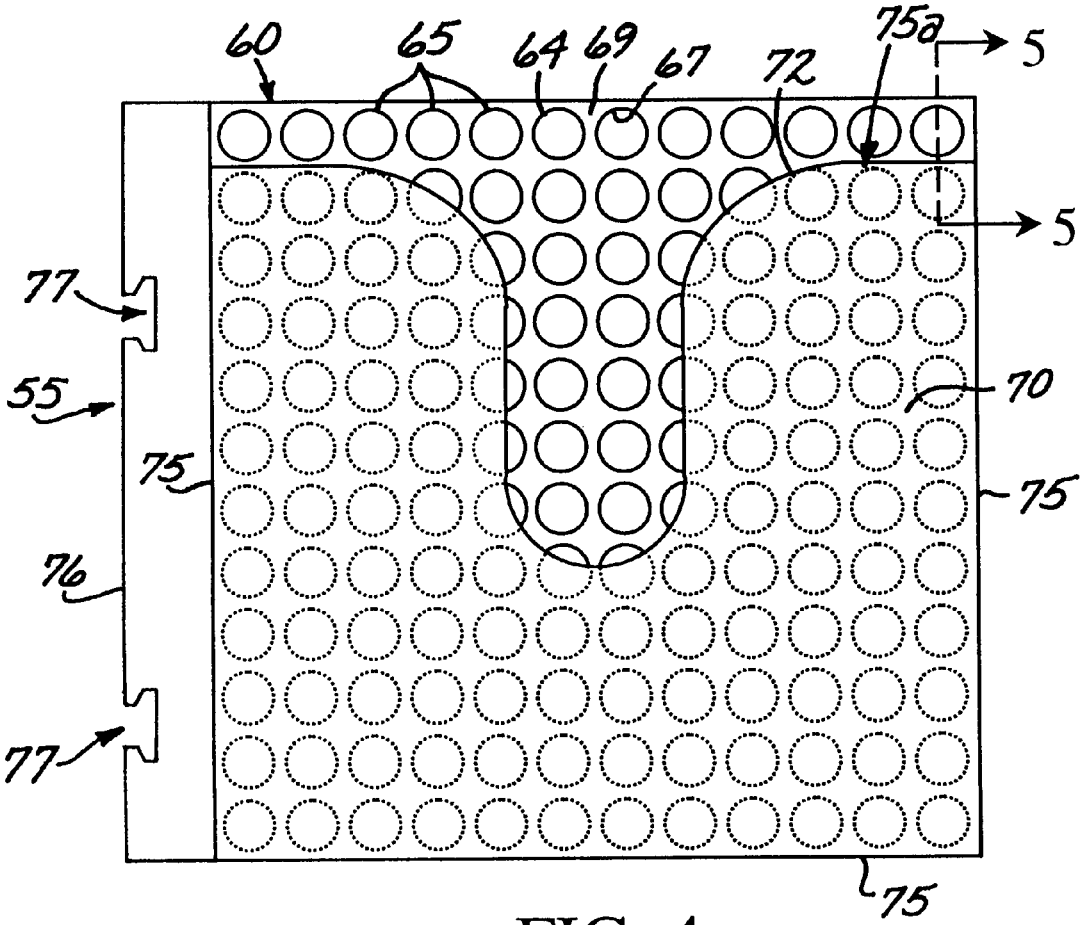
FIG. 4 is a planform view, in reduced scale, of an embossed protective container that incorporates a portion of the embossed plastic material of FIG. 1.

The present invention also contemplates a protective container or sleeve 55, schematically represented by FIG. 4, that incorporates a plurality of generally rectangular plastic sheets 60, 70 bound together at an adhesively bonded, welded, stitched, riveted, or stapled seam 75 along three sides. The welding can be accomplished by any of a number of well-known means which must be compatible for use with the material(s) selected. The present embodiment is compatible for welding using thermal welding or ultrasonic welding techniques, or both. A fourth side has an opening 75*a* that opens to a pocket formed between at least two of the plurality of sheets 60, 70. At least one embossed image 64 or image pattern 65 is molded into at least one of the sheets 60. As with earlier described embodiments, the image 64 or image pattern 65 is formed to have a circumfluent periphery or peripheral edge 67 surrounding the image. The peripheral edge 67 is formed on at least one of the surfaces 69 of the sheet 60. As before, the edge 67 is formed as the plastic sheet material approximately near the edge 67 is partially fractured or sheared from impressing the embossed image 64 or image pattern 65 into the plastic material 60.

In the instant embodiment, the plastic sheet material of sheet 60 is preferably a smooth or non-glare finished plastic material and is more preferably a textured cast polypropylene sheet material with a preferable thickness of approximately 120 microns to approximately 125 microns, and more preferably a minimum thickness of 120 microns (0.120 millimeters or 0.00472 inches) and a maximum thickness of 125 microns (0.125 millimeters or 0.00492 inches). Such material within this approximate range of thicknesses is available from the previously described vendors. As with previously described embodiments, many other types and thicknesses of plastic, elastomer, and composite sheet materials are also equally suitable for purposes of the instant embodiment of the present invention.

The plastic sheet material 70 is also preferably a smooth or non-glare transparent or translucent finished plastic material and is more preferably a non-textured, clear cast polypropylene sheet material with a preferable thickness of approximately 120 microns to approximately 125 microns, and more preferably a minimum thickness of 120 microns (0.120 millimeters or 0.00472 inches) and a maximum thickness of 125 microns (0.125 millimeters or 0.00492 inches). For protective containers 55, 55' intended for use with electrostatically sensitive components, many types of electrostatically protective sheet materials are available from vendors including those listed above.

Figure 5:
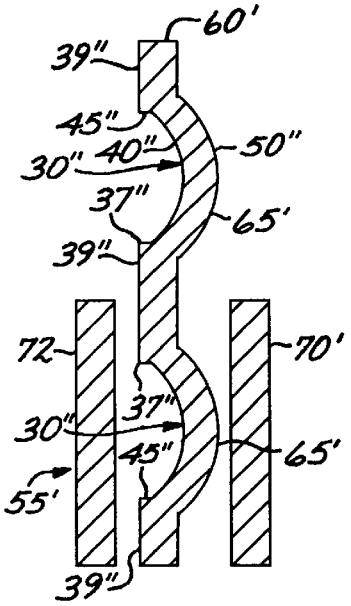
FIG. 5 is a partial, cross-sectional view taken along section line 5—5 of FIG. 4, in enlarged scale, of the embossed protective container of FIG. 4.

As represented in part by FIG. 5, in a variation of this embodiment of the protective container or sleeve 55' of the present invention, a first plastic sheet 70' and a second plastic sheet 72 of the plurality of plastic sheets are arranged to have a third plastic sheet 60', also of the plurality of sheets, interposed between the first and second sheets 70', 72. The third sheet 66' is formed with at least one embossed image 30" or a pattern of images 65'. A first pocket for storing objects is formed between first sheet 70' and third sheet 60'. A second pocket for storing objects is formed on the reverse side of the protective container 55' between second sheet 72 and third sheet 60'. In FIG. 5, the reference numerals having double primes correspond with like reference numerals that reference similar features and elements set forth in earlier descriptions and figures.

Additional sheets of plastic material may be incorporated to the above-described embodiments to increase the number of available pockets. As shown in the preceding figures for purposes of illustration, the pockets are configured for objects having a generally planar shape. However, fabrication of the above-described embodiments using various sizes, configurations, and shapes of plastic sheets to form a variety of pocket sizes is contemplated by the present invention to accommodate storage, transportation, and display of objects of various sizes and shapes. For example, plastic sheets 70, 70', and 72, respectively, can be increased in their respective lateral dimension as otherwise depicted in FIGS. 4 and 5 so that when welded together with the other plastic sheets 60, 60', respectively, a larger or specially shaped pocket is created..

The incorporation of the embossed sheet 60, 60' into the preceding embodiments creates multiple advantages for the present invention. One benefit is that the item stored in the protective containers 55, 55' experiences a protective cushioning effect whereby fragile objects are less likely in suffer damage from inadvertent shock or contact with other objects outside the pocket. Furthermore, the protective containers 55, 55' prevent abrasion damage from occurring to the stored object. First, the outermost plastic sheets 70, 70', and 72 of the containers 55, 55' will absorb any frictional abrasions. Second, as the object is inserted into and removed from the protective containers 55, 55', abrasions to the object are minimized because of the embossed images 30, 30', 30" or image patterns 65, 65', 65" of sheets 60, 60'. The reduced abrasions are experienced because only a reduced surface area of the embossed sheets is in contact with the stored object. Typically, in normal use, only the raised portions 50, 50', 50" of the images or the non-recessed surfaces 39, 39', 39" of the sheet contact the object during storage, insertion, and removal. Accordingly, the surface area of the sheet in contact with the stored object is significantly reduced.

Although not shown in the accompanying views for purposes of clarity, the embossed images 30, 30', 30" or image patterns 65, 65', 65" may be also impressed into the cover sheets 70, 70', and 72. Such embossing of the cover sheets further increases the cushioning of the object during handling, display, and storage. The added embossing also augments the reduced potential for abrasion of the stored object during insertion and removal.

With reference again to FIG. 4, another variation to the protective container 55 is observed. Along one edge 75 of the protective container, a binder tab 75 is shown. The binder tab incorporates binder notches 77 adapted to removably or fixedly attach the protective containers 55, 55' into a larger carrying case, album, or other similar article intended to bind together a plurality of such protective covers 55, 55'. As can be understood with continued reference to FIG. 4, many sizes and types of such tabs 76 and notches 77 may be employed for compatibility with any of a number of different types of binding systems, including for example without limitation, two and three ring binder systems and notebooks. The binder tab 76 and integral notches 77 may also be adapted to attach to a single protective container 55, 55' or a plurality of such protective containers 55, 55'.

Figure 6:
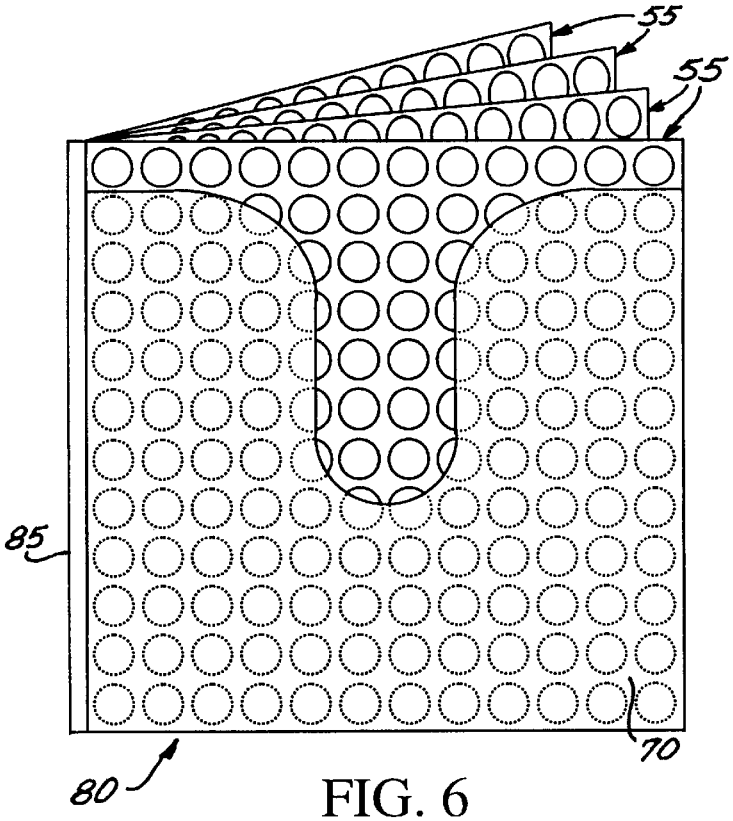
FIG. 6 is an elevated perspective view, in reduced scale, of an album incorporating a plurality of the embossed protective containers of FIG. 4.
Figure 7A:
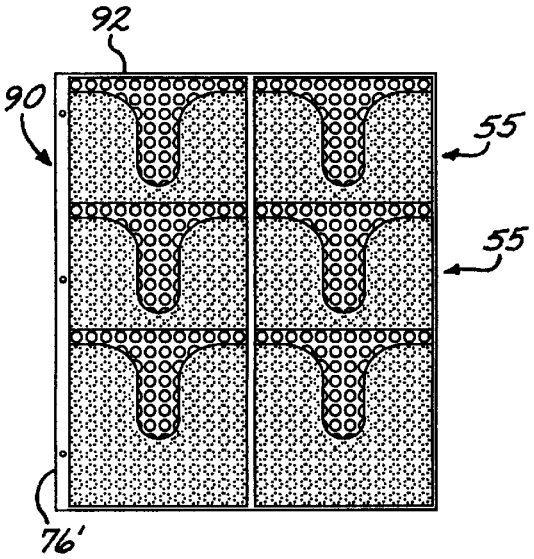
FIGS. 7A and 7B are a planform view, in reduced scale, of a page of embossed protective containers that incorporate the embossed plastic material of FIG. 1.
Figure 7B:
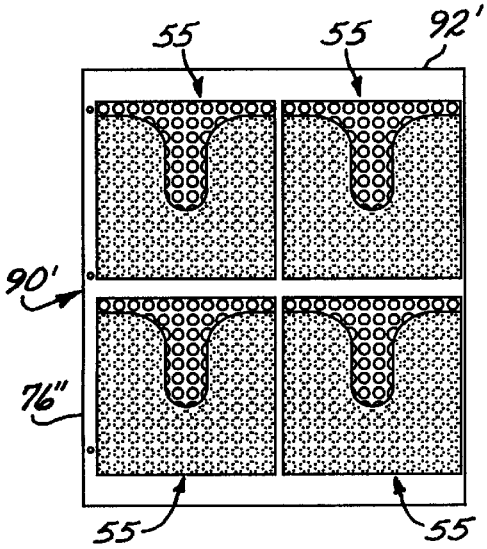

With reference to FIG. 6, it can been understood that binder tab 76 may also be configured as a welded, unnotched tab 85 configured to be fastened to a single protective container such as containers 55, 55' or configured to fasten together a plurality of such containers to form an album 80. With reference to FIGS. 7A and 7B, the protective containers 55, 55' may also be configured to be overlappingly oriented or placed side by side on a standard sized notebook page 90, 90' of a rigid or flexible material such as a plastic sheet 92, 92'. Such a notebook page 90, 90' may further include a binding tab 76', 76" incorporating any of the preceding variations. Each of the protective containers 55, 55' may be affixed permanently or removably to the notebook pages 90, 90' by any of a variety of fastening means including without limitation adhesives, welding, stitching, snaps, hook and loop fasteners, and other well-known fastening means. A front and a back cover may also be added to the album 80 for added protection and for improved aesthetic appearance.

The present invention also contemplates a portable carrying and storage case, not shown but generally having the shape of the protective cover album 80 of FIG. 6 and configured with a front and a back cover joined at a spine, that incorporates the protective containers 55, 55' of the present invention. The cover is made from a sturdy and flexible material such as a woven durable, fabric in widespread use for book bags, back packs, and the like. The cover incorporates a fastening closure means well known to the art, such as zippers and hook and loop, belt and buckle, flexible ties, and snap together fasteners for releasably securing the front cover to the back cover. The carrying case includes a plurality of leaflets, similar to notebook pages, but of any desired, preselected size, that are attached along an edge of each leaflet to the case. Most commonly, the leaflets are attached at one of their edges to the spine of the cover, although this is not a requirement. Attached to each leaflet are one or more protective containers 55, 55'. Each container 55, 55' may include each and any combination of the elements, variations, and components previously described and specifically includes at least one of the plastic sheets 60, 60', 70, 70', 72 formed with images 30, 30', 30" or image patterns 65, 65', 65".

Figure 8:
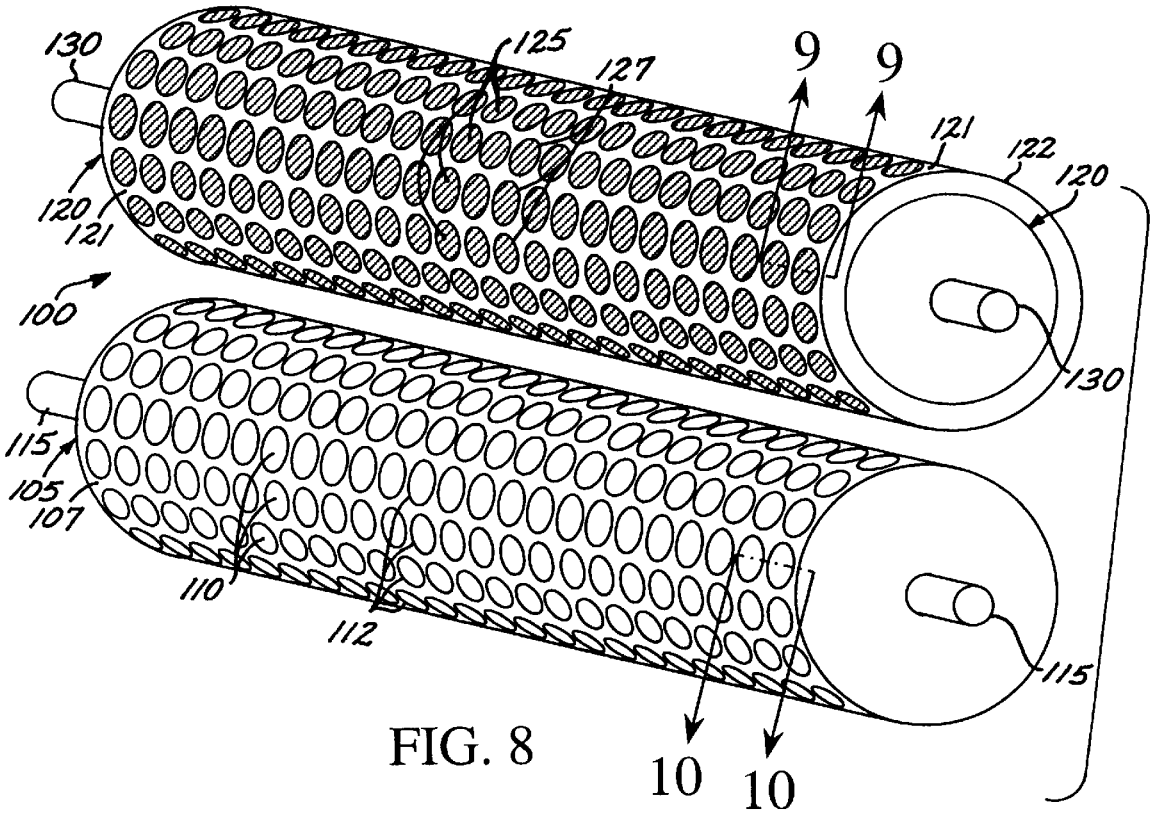
FIG. 8 is an elevated, partial perspective view, in reduced scale, of a roller assembly incorporating rollers configured to fabricate the embossed plastic material of FIGS. 1 and 2A.
Figure 9:
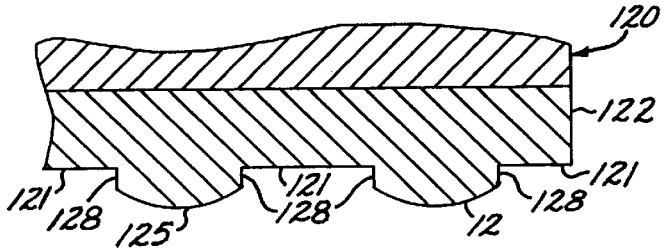
FIG. 9 is a partial, rotated, cross-sectional view taken along section line 9—9 of FIG. 8, in enlarged scale, of one of the rollers of the assembly of FIG. 8.
Figure 10:
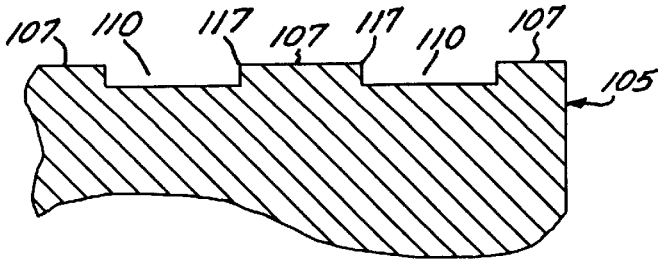
FIG. 10 is a partial, rotated, cross-sectional view taken along section line 10—10 of FIG. 8, in enlarged scale, of another of the rollers of the assembly of FIG. 8.

Also contemplated and described by the present invention is an embossing roller assembly 100 configured to impress an embossed image on a sheet of plastic material. With reference to FIGS. 8, 9, and 10, the assembly 100 incorporates at least two rollers 105, 120 although more than two can be used for appropriate applications. Such applications include embossment of multiple different images on a plastic sheet material. The first roller is mounted about an axle 115 and is preferably a platen roller 105 having a platen surface 107 configured with at least one emboss recess or etched depression 110, or a pattern of such 112, shaped in the form of a preselected image. The platen roller 105 exterior circumferential surface 107, if not the entire roller, is preferably fabricated from a material that has a greater hardness than that of the die roller 120. More preferably, the platen roller 105 is made from any of a number heavy steel pipe materials that are, even more preferably chrome hardened for added hardness, durability, and longevity. The exterior diameter of the roller 105 is preferably approximately 3.50 inches. The length of the roller 105 is preferably approximately 24.0 inches in its longitudinal direction.

In this embodiment of the present invention the preselected image is, for purposes of illustration and not limitation, a portion of a sphere or a bubble, to correspond with the preceding embossed plastic material and protective container embodiments. However, as can be understood to one having ordinary skill in the art, and from reference to the drawings and specification, the article and method of the present invention are readily adaptable to emboss the two- or three-dimensional shape of any conceivable image into a plastic, elastomer, or composite sheet material.

With continued reference to FIGS. 8, 9, and 10, the second roller is also mounted on an axle 130 and is preferably an embossing or impressing roller 120 with a outer die cover 122 formed to have an exterior impressing surface 121. The impressing surface 121 includes at least one emboss die 125, or a pattern of such emboss dies 127, shaped in the form of the preselected image. The platen roller 105 and the impressing roller 120 are cooperatively pressed together in a synchronized rotational relationship. Synchronization is usually accomplished with the rollers 105, 120 being rotatably connected together with a geared drive train or assemblage well-known to the art, but not shown in the drawings. The synchronization of the rollers ensures that rotation of each roller corresponds with the rotation of the other so that each platen recess 110, 112 aligns and registers with each emboss die image 125, 127, as the rollers 105, 120 rotate against one another.

The embossing roller 120 preferably is approximately 3.00 inches in diameter and is made from any of a number heavy steel pipe materials that are, even more preferably chrome hardened for added hardness, durability, and longevity. The exterior outer die cover 122 has a tubular form with an inner diameter that approximately corresponds to the 3.00 inch diameter of the roller 120. The outer die cover 122 has an outer diameter that approximately corresponds with the diameter of the platen roller 105 and has a diameter that is preferably approximately 3.50 inches. The length of the roller 120 and outer die cover 122 are preferably approximately 24.0 inches in their respective longitudinal directions. The outer die cover 122 is preferably made from a material that is preferably approximately softer than the platen roller 105 but that is also preferably somewhat rigid. The outer die cover 122 is more preferably fabricated from a hard, vulcanized natural or synthetic rubber having a Shore "A" Scale Instrument Hardness of approximately 70. This hardness is approximately the same hardness of most rubber automobile tires.

The rollers 105, 120 are configured to be compressed against one another using a threaded vise, compress, or ratcheting latch system, or some combination thereof. For purposes of clearly illustrating particular embodiments of the present invention, the latching and pressure adjustment system has been removed from the drawings. However, such roller latching and compression adjustment systems are well-known to the art of printing and embossing presses. The latching system operates to move the axles 105, 130 towards and away from one another with a continuous adjustment capability so that the compressive force of the rollers 105, 130 may be adjusted to accommodate various types or formulations, hardnesses, and thicknesses of plastic sheet material (see, for example, FIG. 17) and to increase or decrease the depth of the partial shearing or fracturing and depth of the embossed image of the plastic material as it is directed through the roller assembly 100. The plastic sheet material is rolled through the roller assembly 100 to form at least one relief image 100, 112 in the shape of the preselected image. Each formed image 100, 112 includes the stepped circumfluent periphery or peripheral edge and the associated features and elements described above in detail with respect to each of the preceding embodiments and variations thereof.

With reference again to FIGS. 9 and 10, each recess 110 of the platen roller 105 is formed with a peripheral edge 117 having a first predetermined diameter. Each emboss die 125 of the impressing roller 120 includes a circumferential riser 128 having a second predetermined diameter. In the preferred embodiment of the present invention, the first diameter is preferably and approximately the same as the second diameter. Both diameters, along a longitudinal tangent to the respective rollers 105, 120 are approximately 0.24 inches (13.89 millimeters) to approximately 0.31 inches (18.06 millimeters), and more preferably are approximately 0.27 inches (15.66 millimeters). Each platen recess 110 and emboss die 125 are spaced apart in a pattern on the respective rollers 105, 120 with a longitudinal and circumferential center-to-center spacing of approximately 0.308 inches (17.94 millimeters) to approximately 0.318 inches (18.54 millimeters), and more preferably are approximately 0.3125 inches (18.21 millimeters). In this configuration, as the plastic sheet material is directed between the rollers 105, 120, when they are compressed together, the region of plastic material in contact is pressed into the recess 110 by the die 125. As this occurs, the surface of the plastic material in contact with the die 125 is fractured or partially sheared to form the stepped circumfluent periphery or peripheral edge in the shape of the preselected image. In operation, the die 125 top surface is pressed against and compressed into the platen recess 110 so that edge 128 slides against edge 117 and into the platen recess 110. For certain variations of the present invention, the diametrical distance between the opposing recess edges 117 may preferably be approximately larger than the diametrical distance between die edges 128 to increase the size or depth, or both, of the circumfluent periphery or edge near the region of the fracture or partial shearing of the plastic sheet material.

For purposes of illustrating examples of additional roller assemblies capable of embossing various types of plastic sheet materials with various types of image patterns and alternating image patterns, including those described with reference to the embodiments of FIGS. 2A, 2B, 3, and 5, reference is made to FIGS. 11 through 16. The reference numerals having primes and double primes correspond with like reference numerals that reference similar features and elements set forth in earlier descriptions and figures.

Figure 11:
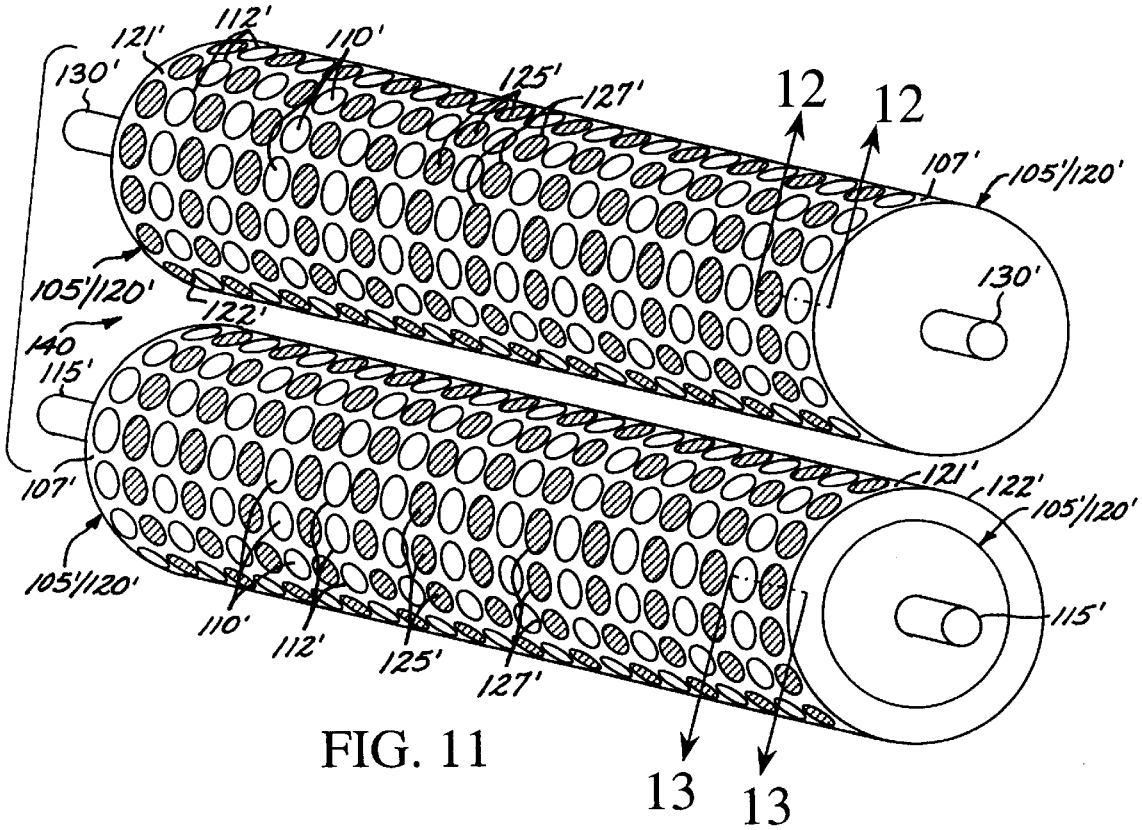
FIG. 11 is an elevated, partial perspective view, in reduced scale, of a roller assembly incorporating rollers configured to fabricate another preferred embodiment of the embossed plastic material of FIGS. 1 and 2B.
Figure 12:
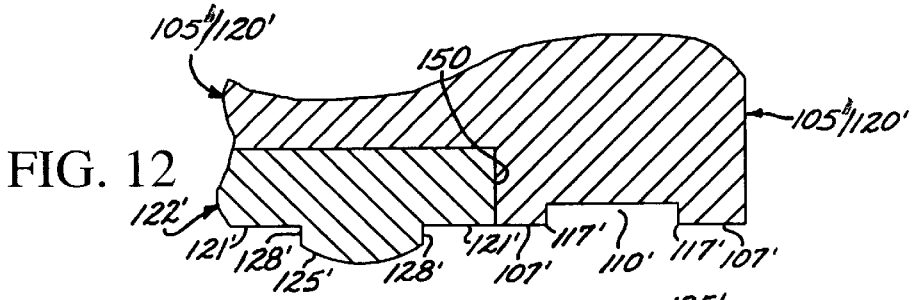
FIG. 12 is a partial, rotated, cross-sectional view taken along section line 12—12 of FIG. 11, in enlarged scale, of one of the rollers of the assembly of FIG. 11.
Figure 13:
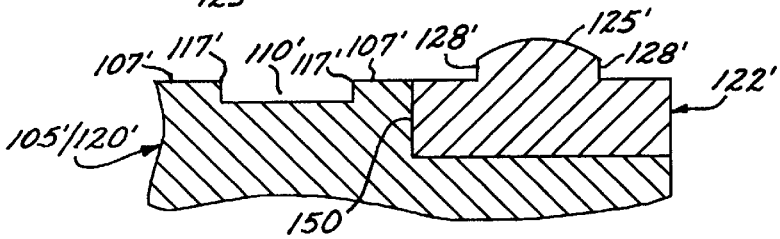
FIG. 13 is a partial, rotated, cross-sectional view taken along section line 13—13 of FIG. 11, in enlarged scale, of another of the rollers of the assembly of FIG. 11.

In FIGS. 11 and 14, respectively, roller assemblies 140 and 170 are shown that incorporate hybrid or combination rollers. With reference to FIGS. 11, 12, and 13, the hybrid configuration of the roller assembly 140 includes platen/die hybrid rollers 105'/120'. Each hybrid roller 105'/120' incorporates both platen recesses 110' and emboss dies 125' in alternating patterns 112', 127'. Each roller 105'/120' is configured with channels, keyways, or chases 150. In each chase 150, an outer die cover 122' is included having die surface 122' with emboss dies 125'. With reference to FIGS. 14, 15, and 16, hybrid rollers 105"/120" include similar features and elements. In this variation of the present invention, the emboss dies 125" are formed on the surface 121" on outer die cover 122", that, in turn, is incorporated into cavities 180 adapted to receive the die covers 122".

Figure 17:
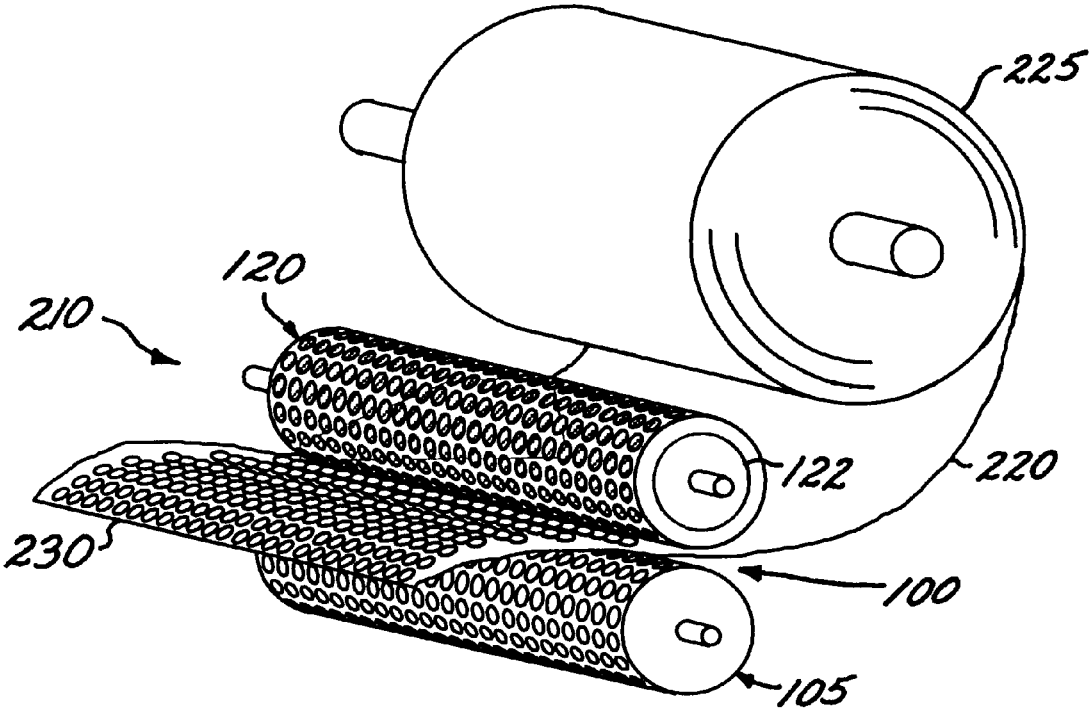
FIG. 17 is an elevated, partial perspective view, in reduced scale, of an embossing station incorporating the roller assembly of FIG. 8 configured to fabricate the embossed plastic material of FIGS. 1 and 2A.

With reference to FIG. 17, an embossing station 210 is described that incorporates the previously described roller assembly 100. Although not shown, any of the preceding roller assemblies 140, 170 may be employed alone or in combination to emboss any of the preceding plastic sheet materials with any of the previously described images or image patterns. The plastic sheet material 220 is directed from a roll 225 between the rollers 105, 120 of roller assembly 100 to emboss the plastic sheet material 220 and to thereby manufacture the embossed plastic sheet material 230.

From the foregoing, it can be appreciated that the present invention fulfills a real but heretofore unmet need for an improved, inexpensive, durable, and long-lasting embossed plastic sheet material and a method for manufacturing and embossing such material that overcomes the deficiencies of the presently known materials and methods for manufacture. In addition, these advancements improve the cushioning capability of the embossed plastic materials used in protective containers by increasing the post-embossing relief height, resilience, durability, and three-dimensional stability of the embossed image. Another benefit of the preferred embossed plastic material is that it also minimizes the surface area of plastic in contact with the item stored in the protective container to, in turn, minimize the frictional abrasion of the item by the plastic material as the item is inserted and removed from the protective container.

Each of the described embodiments and variations, as well as other obvious yet undescribed embodiments of the invention, and equivalents thereof, may be used either alone or in combination with each of the other embodiments. While particular preferred embodiments of the invention have been illustrated and described, various modifications and combinations can be made without departing from the spirit and scope of the invention, and all such modifications, combinations, and equivalents are intended to be covered and claimed.

What is claimed is:

1. A protective container, comprising:

a plurality of plastic sheets bound together at a seam and configured with an opening into a pocket formed between at least two of the plurality of sheets;

at least one embossed image molded on at least one of the sheets and having an edge surrounding the image and formed on one surface of the sheet; and wherein the edge is formed on the one surface as the material approximately near the edge is partially sheared from impressing the embossed image into the plastic material.

2. A protective container according to claim 1 wherein first and second plastic sheets of the plurality are arranged to form a pocket therebetween and wherein the embossed image is formed on the second sheet.

3. A protective container according to claim 1 wherein first and second plastic sheets of the plurality are arranged to have a third plastic sheet of the plurality therebetween and wherein the third sheet is formed with the at least one embossed image.

4. A protective container according to claim 3 wherein first and second pockets are formed, respectively, between the first and third sheets, and the second and third sheets.

* * * * *